United States Patent [19]

Scheurecker

[11] 4,411,053

[45] Oct. 25, 1983

[54] ARRANGEMENT FOR EXCHANGING SUPPORTING OR DRIVING ROLLERS OF A CONTINUOUS CASTING PLANT

[75] Inventor: Werner Scheurecker, Linz, Austria

[73] Assignee: Voest-Alpine Aktiengesellschaft, Linz, Austria

[21] Appl. No.: 161,144

[22] Filed: Jun. 19, 1980

[30] Foreign Application Priority Data

Jul. 25, 1979 [AT] Austria ..... 5129/79

[51] Int. Cl.[3] ..... B23P 19/04

[52] U.S. Cl. ..... 29/267; 29/281.1

[58] Field of Search ..... 29/426.2, 402.08, 426.3, 29/252, 267, 281.1, 281.4; 269/254 R; 164/448; 72/239, 238

[56] References Cited

U.S. PATENT DOCUMENTS 2,664,860 1/1954 Levetus ..... 269/34
3,328,973 7/1967 Scheib ..... 72/239
3,994,334 11/1976 Schrewe .
4,012,825 3/1977 Gränitz et al. ..... 29/426.2

FOREIGN PATENT DOCUMENTS 1920757 10/1973 Fed. Rep. of Germany .
2504558 12/1976 Fed. Rep. of Germany .

*Primary Examiner*—Robert C. Watson
*Attorney, Agent, or Firm*—Brumbaugh, Graves, Donohue & Raymond

[57] ABSTRACT

An arrangement for exchanging supporting or driving rollers of a continuous casting plant with a strand guide including two oppositely arranged roller ways includes a sled that is movable between the roller ways for transporting a roller to and away from a bearing place in one of the roller ways. The sled is equipped with roller seats receiving the rollers and includes means for moving a roller from its bearing place to the sled and from the sled to the bearing place. The roller seats are arranged on the sled so as to be movable transversely to the longitudinal direction of the rollers and they are movable by means of an adjustment device out of a transporting position retracted in the sled into an engagement position projecting out of the sled.

5 Claims, 5 Drawing Figures

ARRANGEMENT FOR EXCHANGING SUPPORTING OR DRIVING ROLLERS OF A CONTINUOUS CASTING PLANT

BACKGROUND OF THE INVENTION

The invention relates to an arrangement for exchanging supporting or driving rollers of a continuous casting plant with a strand guide including two oppositely arranged roller ways, the arrangement comprising a sled that is movable between the roller ways for transporting a roller to and away from a bearing place in one of the roller ways, which sled is equipped with roller seats receiving the rollers and includes means for moving a roller from its bearing place to the sled and from the sled to the bearing place.

The supporting and driving rollers in continuous casting plants, in particular in continuous steel casting plants, constitute especially highly worn machine parts. Their service life is relatively short as compared with other machine parts of continuous casting plants. For this reason the supporting and driving rollers quite frequently must to be exchanged for new or overhauled rollers in the course of maintenance works. If there is a failure of certain supporting or driving rollers, the defective rollers must to be replaced within the shortest time possible in order to avoid longer stop periods of the plant.

From U.S. Pat. No. 4,012,825 an arrangement of the initially-defined kind is known, wherein for instance an installation of a roller into the continuous casting plant is effected in a manner that the roller to be installed is placed into a roller seat of the sled, is transported to between the roller ways by the sled and is inserted into the bearing place of the roller way by means of a guide which is laterally fastenable to the sled or to the roller ways and on which guide a follower is guided which is engageble with the respective roller end of the roller to be installed.

The attachment of the lateral displacement means necessitates the consumption of additional time. An operator must enter laterally of the strand guide as far as to the roller to be exchanged in order to attach the displacement means. This is a difficult procedure due to the small space laterally of the strand guide.

SUMMARY OF THE INVENTION

The present invention aims at avoiding these difficulties and has as its object to provide an arrangement of the initially-defined kind with which the time that is necessary for a roller exchange can be shortened considerably, in which the exchange procedure on the whole is simplified, and with which in particular the space laterally of the strand guide is not required for exchanging rollers.

This object is achieved according to the invention in that the roller seats are arranged on the sled so as to be movable transversely to the longitudinal direction of the rollers, and are movable by means of an adjustment device out of a transporting position retracted in the sled into an engagement position projecting from the sled.

Suitably, the roller seats are fastened to pivot arms hinged to the sled.

If only little space is available between the roller ways, the roller seats suitably are pivotably fastened to pivot arms hinged to the sled and provided with projections, which projection contacts a stop of the pivot arm with the roller seat in the retracted transporting position, and contacts the roller adjacent the roller to be removed with the roller seat in the engagement position projecting from the sled.

A preferred embodiment is characterized in that the roller seats are pivotably fastened to pivot arms hinged to the sled and are each provided with a projection which contacts a stop of the sled in the transporting position of the roller seat. A catch is pivotably fastened to each of the pivot arms, which catch on the one hand contacts with one of its ends, with a nose, the projection of the roller seat, and with its other end contacts a stop that is arranged within the sled, wherein the catch holds the roller seat with its opening accommodating the roller being constantly directed towards the roller. The arrangement may thus be utilized also with roller ways that are most tightly arranged opposite each other, in which the rollers are also arranged very closely adjacent one another.

For exchanging the rollers lying on the upper roller way, it is advantageous if the roller seats are designed as elastically deformable, resilient clamps encompassing the rollers.

According to a further preferred embodiment, the roller seats comprise pivotable bars that are insertable between the rollers of the roller way, engage the rollers from behind and are pivotable about an axis arranged perpendicular to the roller way, from a position parallel to the roller axes into a position transverse to the roller axes, whereby it is possible to seize the rollers of the lower roller way safely, and to secure them in the roller seats. Suitably, the pivot arm is designed as an angle lever on whose one lever arm the roller seat is mounted and to whose other lever arm a pressure medium cylinder hinged to the sled is articulately fastened.

BRIEF DESCRIPTION OF THE DRAWINGS

The arrangement according to the invention will now be explained in more detail by way of three exemplary embodiments with reference to the schematic drawings, wherein.

DESCRIPTION OF EXEMPLARY EMBODIMENTS

Figure 1:
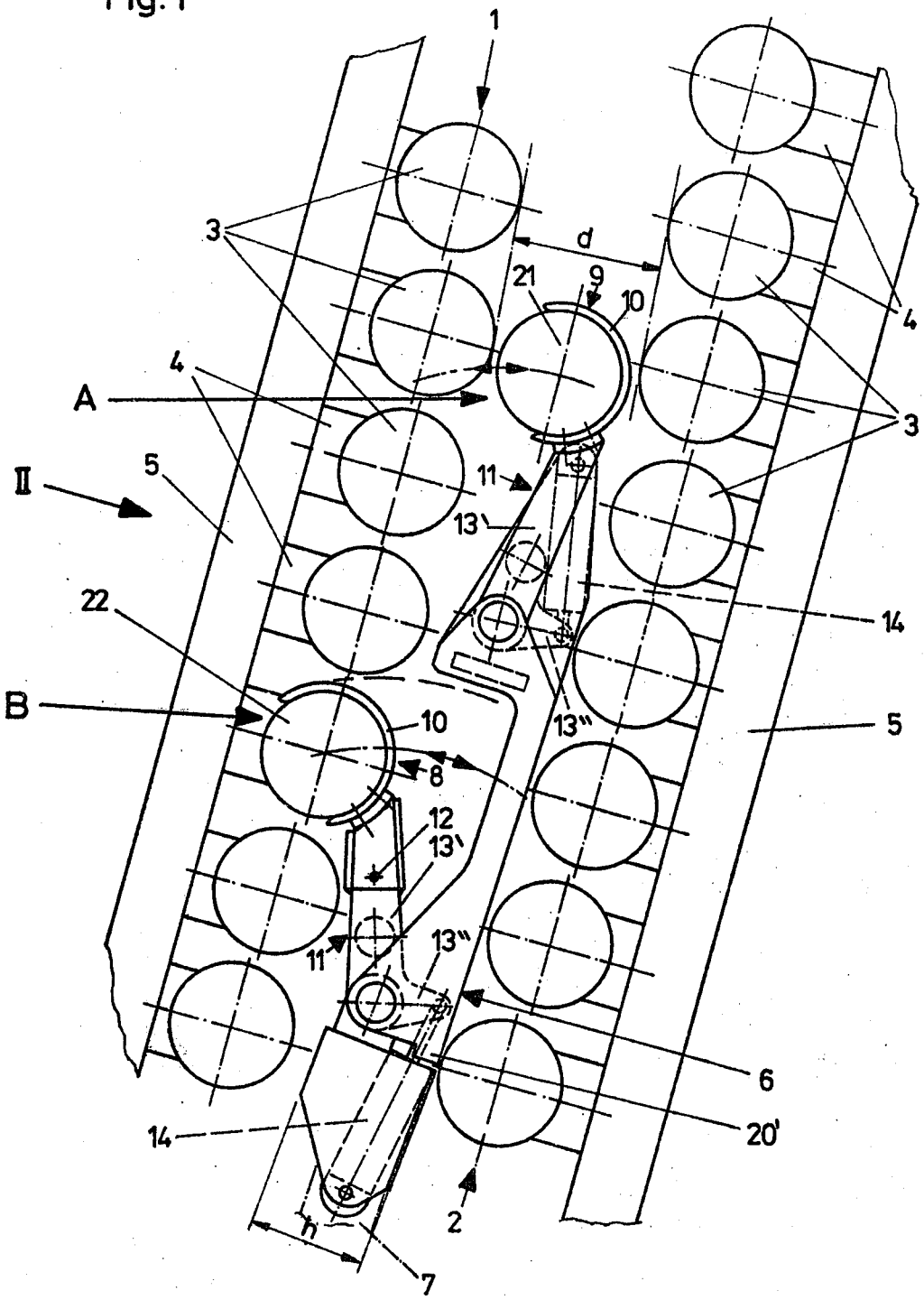
FIG. 1 is a longitudinal section through part of a schematically illustrated strand guide in which a sled according to a first embodiment for exchanging the rollers provided at the inner or upper side of the strand guide is shown.

The inner roller way 1 and the outer roller way 2 of a strand guide comprise supporting rollers 3 between which a strand is guided during casting. A number of supporting rollers 3 is each mounted via bearing brackets 4 in a stand segment 5. A sled 6, whose height h is slightly smaller than the roller way distance d, is articulately connected with a starter bar 7, represented in dot-and-dash lines in FIG. 2, and can be displaced in the longitudinal direction between the roller ways together with the same. The sled 6 includes two roller seats 8, 9 arranged one behind the other, which are designed as elastically deformable, resilient clamps 10 encompassing the rollers.

Each of the roller seats is immovably fastened to a pivot arm 11 hinged to the sled 6, but can be drawn from the pivot arm 11 by loosening a pin 12, as is illustrated in detail at the lower roller seat 8. The pivot arm is designed as an angle lever, which is hinged to the sled in the intersection of its lever arms 13', 13''. One of the lever arms 13' carries the roller seat 8 or 9, respectively; the other lever arm 13'' is hinged to a piston rod of a pressure medium cylinder 14, which is articulately fastened to the sled 6. With the help of the pressure medium cylinders, the roller seats are pivotable from a transporting position A retracted in the sled (cf. upper roller seat in FIG. 1) into an engagement position B projecting from the sled (cf. lower roller seat in FIG. 1), and vice versa.

The sled itself is formed by side cheeks 15, which are connected with each other via a crosshead 16 and pipes 17.

Due to the length of the rollers to be exchanged, two pivot arms 11 are each arranged parallel to each other and connected with each other by means of a pipe 18 for the purpose of synchronization. The side cheeks 15 of the sled are articulately connected with a crosshead 19 via the lower pipe 17 penetrating the side cheeks 15, on the one hand, and holding means 20 welded to the crosshead 19, on the other hand. For limiting the movability of the side cheeks of the sled relative to the crosshead 19, stops 20' are provided on the side cheeks 15.

The arrangement functions in the following manner: A new or intact strand guiding roller 21 is placed into one of the roller seats 9 of the sled 6. The sled 6 is coupled to the starter bar 7, which is introduced into the strand guide with the help of drivable rollers provided in the strand guide. In this case, the roller seats 8, 9 are in the transporting position A. The sled 6 is moved in until the initially empty roller seat 8 is at the height of the defective roller 22. With the help of the hydraulic pressure medium cylinder 14, the pivot arms 11 carrying the empty roller seat 8 are then moved towards the roller 22 to be exchanged into the engagement position B until the clamps 10 encompass the defective roller 22. After detaching the defective roller 22 out of the bearing brackets 4, the pivot arms 11 are again pivoted back into the transporting position A.

Subsequently, the sled is moved until the new roller 21 is at the height of the gap where the defective roller 22 was. With the help of the hydraulic pressure medium cylinder 14 the new roller 21 is now inserted into the gap. After mounting the roller to the bearing brackets, the pivot arms 11 are pivoted back into the transporting position A, the clamps 10 automatically unlatching from the roller. Due to the fact that the roller seats 8, 9 are designed as resilient clamps 10, it is possible to use them for rollers of different diameters.

The resilient clamps 10 make possible a safe and particularly simple exchange of the rollers of the arc inner or upper strand guide way 1. If the rollers of the arc outer or lower roller way 2 are exchanged, measures have to be taken that the rollers that have been inserted into the roller seats will not fall out of the roller seats due to their own weight. An embodiment for realizing this is represented in FIGS. 3 and 4.

Figure 3:
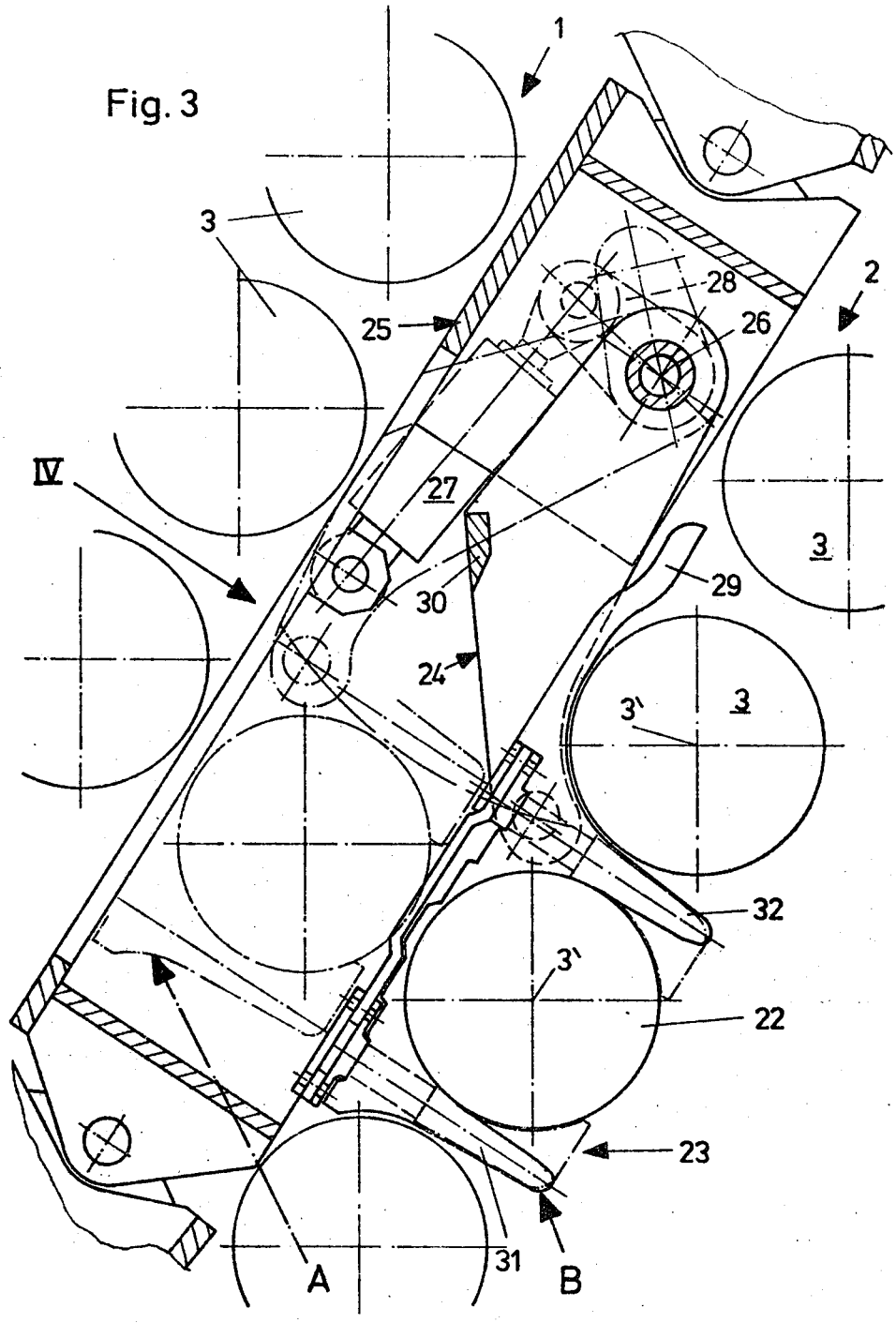
FIG. 3 shows, in a partly sectioned illustration analogous to FIG. 1, a further embodiment of the arrangement according to the invention for exchanging the rollers arranged at the outer or lower side of the strand guide.

As can be seen from FIG. 3, a fork-shaped roller seat 23 is articulately fastened to a pivot arm 24, which is mounted in a sled 25 so as to be pivotable about the axis 26. The pivot arm 24 is again designed as an angle lever and actuatable by means of a pressure medium cylinder 27 which is hinged to a lever arm 28 of a pivot arm on the one hand and to the sled 25 on the other hand. The fork-shaped roller seat 23 has a projection 29, which, in the engagement position B of the roller seat 23, contacts the roller 3 that is adjacent the roller 22 to be exchanged, and in the transporting position A of the roller set 23, contacts a stop 30 of the pivot arm 24. This projection 29 thereby causes an exact alignment of the fork-shaped roller seat 23 with the fork opening towards the roller 22 to be exchanged, the fork-shaped roller seat 23 thus being easily pivotable into the engagement position B also between closely adjacent rollers 3.

The forks of the fork-shaped roller seat are comprised of pivotable bars 31, 32 that engage the rollers from behind. The bars 31, 32 are pivotable from a position parallel to the roller axes 3' into a position transverse to the roller axes, as is illustrated in FIG. 3 by dot-and-dash lines, by means of a linkage that is drivable by a preferably hydraulically actuatable pressure medium cylinder.

Figure 4:
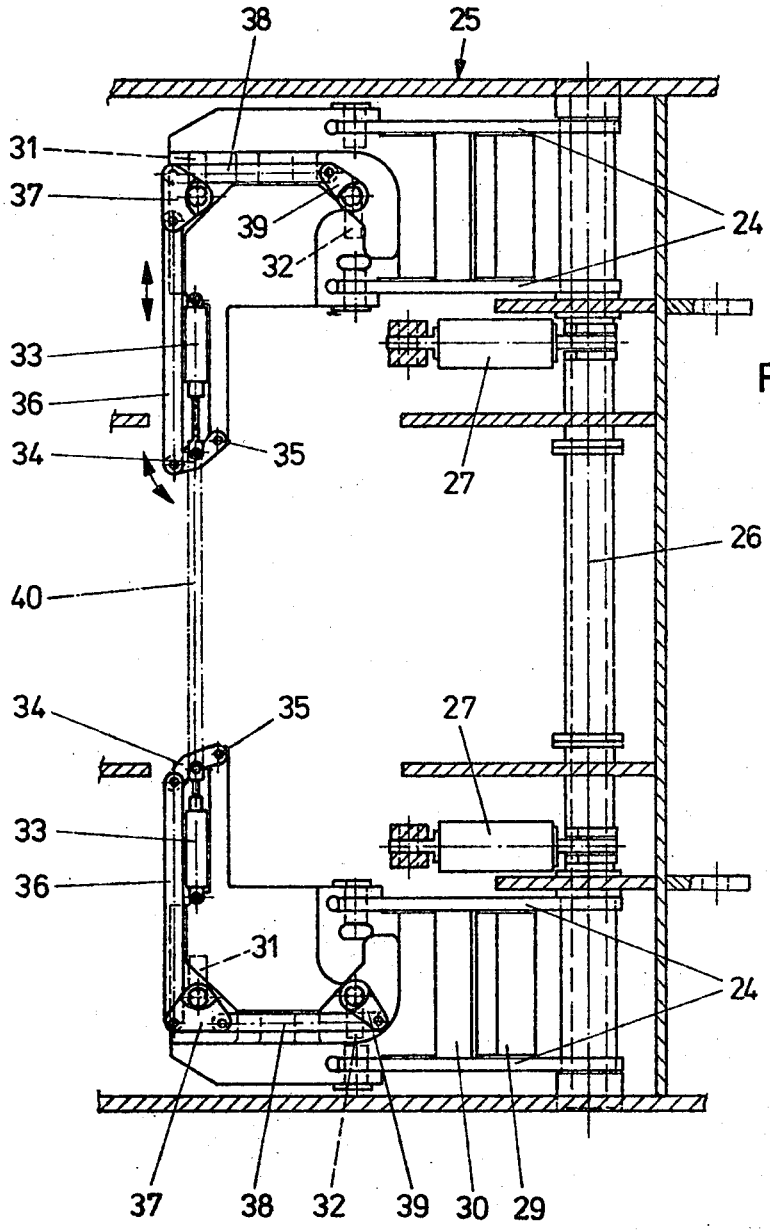
FIG. 4 is a partly sectioned view of the sled in the direction of the arrow IV of FIG. 3.

As can be seen from FIG. 4, in which the linkage is illustrated in more detail, two hydraulic pressure medium cylinders 33 are provided, which are hinged with their piston rods to pivot levers 34. These pivot levers 34 are articulately connected with the sled 25 (at 35) on the one hand, and are articulately connected with the lever linkage consisting each of a first push rod 36, an angle lever 37, a further push rod 38 and a lever 39, on the other hand. To the angle lever 37 and to the lever 39 one of the bars 31, 32 is each fastened. Instead of the two pressure medium cylinders 33, it is also possible to provide only one, wherein in that case a connection rod 40 will be provided between the oppositely arranged pivot levers 34, as is indicated in FIG. 4 by dot-and-dash lines.

Figure 2:
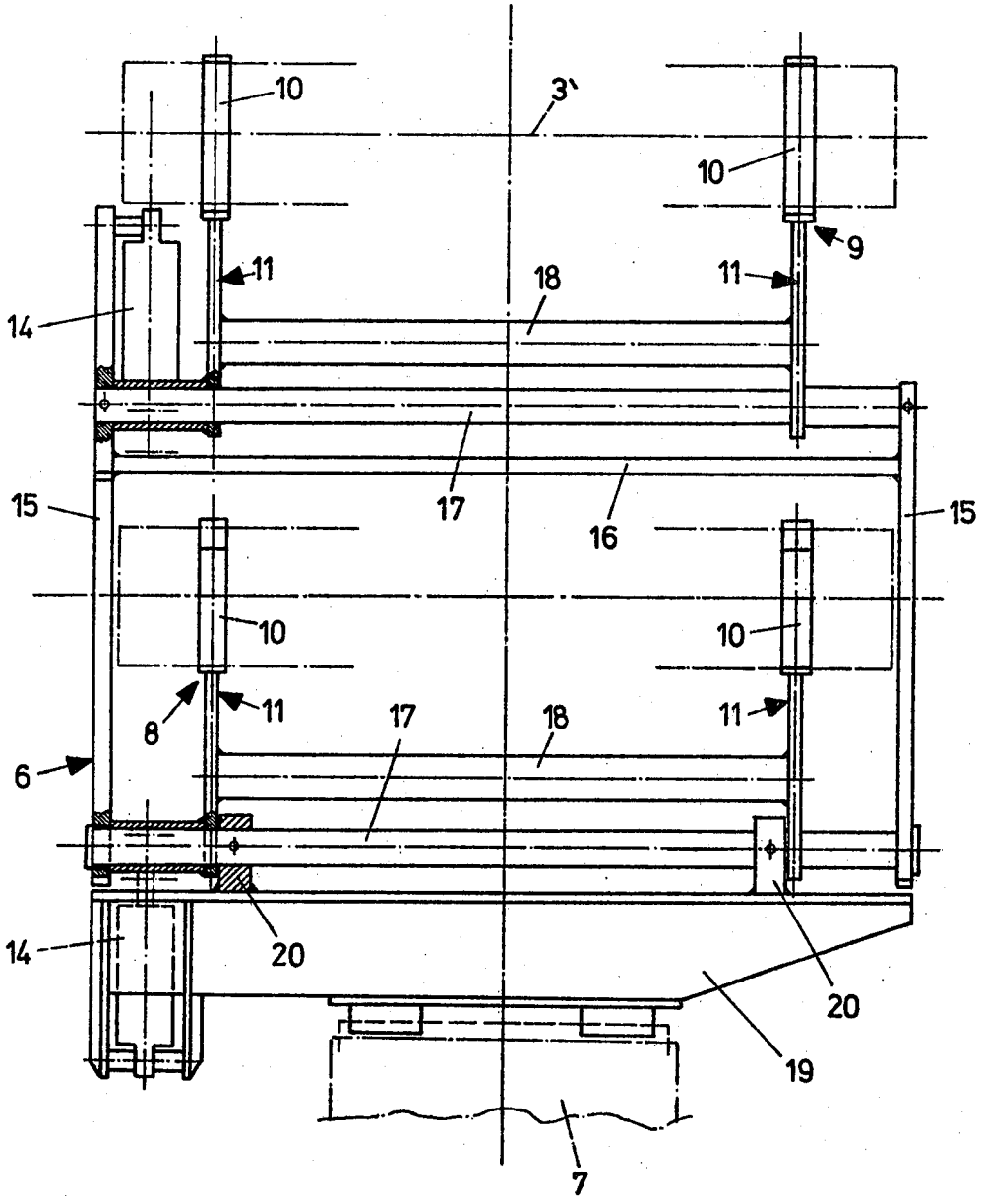
FIG. 2 is a view of the sled, partly sectioned according to arrow II of FIG. 1 (the roller ways being omitted)

The functioning of this embodiment is similar to that of the embodiment illustrated in FIGS. 1 and 2. The roller is fixed in the roller seat 23, after it has been placed into the roller seat 23 and laterally encompassed by the roller seat 23, by pivoting the bars 31, 32—by actuation of the pressure medium cylinders 33.

Figure 5:
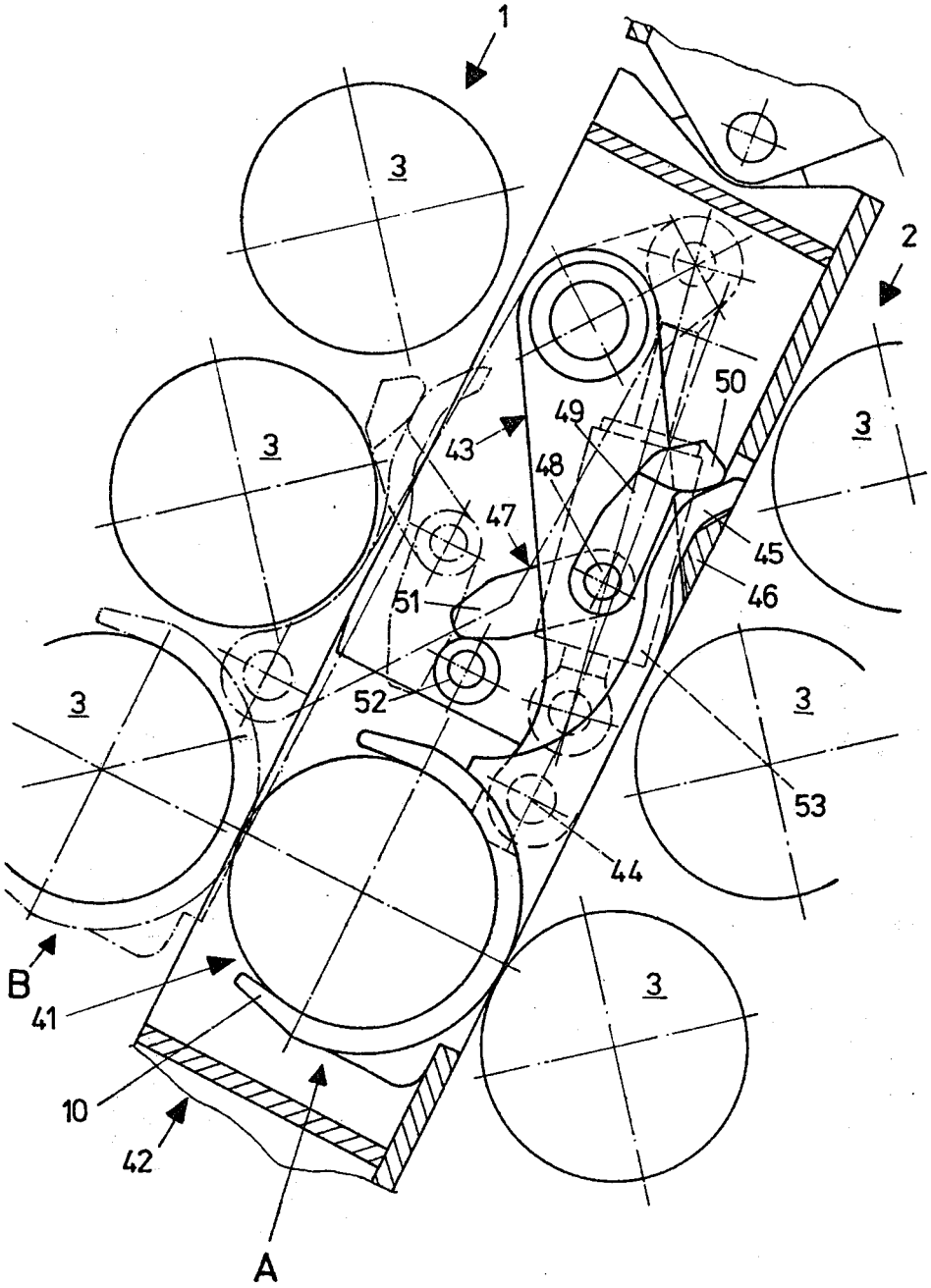
FIG. 5 represents a further embodiment in an illustration analogous to FIG. 1.

In FIG. 5 a further embodiment is illustrated which is suitable for particularly close roller ways 1, 2 in which also the rollers 3 are particularly closely arranged one adjacent the other. According to this embodiment, the roller seat 41, which in this case is also designed as a resilient clamp 10, is articulately arranged on a pivot arm 43 (at 44) hinged to sled 42. The roller seat 41 comprises a projection 45 which, in the transporting position A of the roller seat 41, contacts a stop 46 of the sled, as is shown in FIG. 5 in full lines. When pivoting the roller seat 41 into the engagement position B projecting out of the sled, which is illustrated in FIG. 5 in dot-and-dash lines, the projection 45 comes into engagement with the roller 3 adjacent the roller to be exchanged. The exact alignment of the roller seat 41 during this pivot movement is effected by an angular catch 47 which is pivotably fastened to the pivot arm 43 at axis 48. An arm 49 of the catch 47 constantly (i.e., also during the pivot movement) presses the projection 45 of the roller seat 41 with a nose 50. The other arm 51 of this catch 47 contacts a roller 52 rotatably mounted in the sled casing. By this catch the projection is constantly held parallel to the roller ways 1, 2 or parallel to the upper and lower sides of the sled 42. As with the above-described embodiments, a pressure medium cylinder 52 is used to move the pivot arm 43.

The invention is not limited to the embodiments illustrated, but can be modified in various aspects. For instance, it is possible to provide as an adjustment drive for the pivot arms of the roller seats any desired driving means. Also need the roller seats not necessarily be fastened to the pivot arms, they can be moved out of the sled into the engagement position and back also by other displacement means, for instance by means of jack-like constructions, by means of adjustment spindles or the like.

When exchanging rollers, several sleds may be hinged to the starter bar one behind the other, sleds of various embodiments being combinable. This is necessary, if for instance defective rollers are to be removed from the upper and lower roller ways in one working cycle and these defective rollers are replaced in the upper and lower roller ways in another working cycle.

What I claim is:

1. In an arrangement for exchanging supporting or driving rollers of a continuous casting plant of the type including:

a strand guide, a first roller way and a second roller way arranged opposite each other on said strand guide and having bearing means accommodating rollers, a sled adapted for movement between said first and said second roller ways for transporting a desired roller to and away from its respective bearing means, roller seats on said sled for receiving a roller, and moving means for moving a roller from its respective bearing means to said sled, and from said sled to its respective bearing means, the improvement wherein:

said moving means comprises an adjustment means, and said roller seats are mounted on pivot arms hinged to said sled so as to be movable by operation of said adjustment means when said sled is between said roller ways, in a direction transverse to the longitudinal direction of said rollers, between a transporting position in which said roller seats are retracted in said sled and an engagement position in which said roller seats project out of said sled, and wherein each of said roller seats includes a projection and each of said pivot arms includes a stop, said roller seat projection contacting said pivot arm stop when in said retracted position and contacting a roller adjacent the roller to be exchanged when in said engagement position.

2. In an arrangement for exchanging supporting or driving rollers of a continuous casting plant of the type including:

a strand guide, a first roller way and a second roller way arranged opposite each other on said strand guide and accommodating rollers, bearing means on said first and said second roller ways for accommodating said rollers, a sled adapted for movement between said first and said second roller ways for transporting a desired roller to and away from its respective bearing means, roller seats on said sled for receiving a roller, and moving means for moving a roller from its respective bearing means, the improvement wherein:

said moving means comprises an adjustment means, and said roller seats each have a roller-receiving opening and are mounted on pivot arms hinged to said sled so as to be movable by operation of said adjustment means when said sled is between said roller ways, in a direction transverse to the longitudinal direction of said rollers, between a transporting position in which said roller seats are retracted in said sled and an engagement position in which said roller seats project out of said sled, and wherein each of said roller seats includes a projection and each of said pivot arms includes a catch pivotably mounted thereon having a first end with a nose contacting said roller seat projection and a second end, and wherein said sled has a first stop means which contacts said roller seat projection in said transporting position, and a second stop means which contacts said second end of said catch, said catch holding said roller seat whereby its roller-receiving opening is constantly directed toward said desired roller.

3. In an arrangement for exchanging supporting or driving rollers of a continuous casting plant of the type including:

a strand guide, a first roller way and a second roller way arranged opposite each other on said strand guide and accommodating rollers, bearing means on said first and said second roller ways for accommodating said rollers, a sled adapted for movement between said first and said second roller ways for transporting a desired roller to and away from its respective bearing means, roller seats on said sled for receiving a roller, and moving means for moving a roller from its respective bearing means, the improvement wherein:

said moving means comprises an adjustment means, and said roller seats are mounted on said sled for movement by operation of said adjustment means when said sled is between said roller ways, in a direction transverse to the longitudinal direction of said rollers, between a transporting position in which said roller seats are retracted in said sled and an engagement position in which said roller seats project out of said sled, and wherein said roller seats comprise pivotable bars introduceable between said rollers of one of said first and said second roller ways so as to engage said rollers from behind, said bars being pivotable about an axis arranged perpendicular to one of said first and said second roller ways from a position parallel to the axes of said rollers into a position transverse to the axes of the rollers.

4. An arrangement as set forth in either of claims 1 or 2, wherein said roller seats comprise elastically deformable resilient clamps adapted to encompass said rollers.

5. An arrangement as set forth in any of claims 1, 2 or 3, wherein said pivot arms comprise angle levers having a first lever arm to which said roller seat is mounted and a second lever arm, and wherein said adjustment means comprises a pressure medium cylinder hinged to said sled and articulately fastened to said second lever arm.

* * * * *